US005386957A

United States Patent [19]

Miller

[11] Patent Number: 5,386,957

[45] Date of Patent: Feb. 7, 1995

[54] HAND GLIDING SUPPORT

[76] Inventor: George V. Miller, 704 Vassar, SE., Albuquerque, N. Mex. 87106

[21] Appl. No.: 116,748

[22] Filed: Sep. 7, 1993

[51] Int. Cl.[6] ..... B43L 15/00

[52] U.S. Cl. ..... 248/118.5; 248/918; 400/715

[58] Field of Search ..... 248/118, 118.1, 118.3, 248/118.5, 429, 346, 918, 122; 400/715, 717, 719

[56] References Cited

U.S. PATENT DOCUMENTS

| | | | |
|---|---|---|---|
| 520,711 | 5/1894 | Shea | 248/118.5 |
| 794,042 | 7/1905 | O'Connor | 248/118.3 |
| 4,482,064 | 11/1984 | Berke et al. | 248/118 X |
| 4,913,390 | 4/1990 | Berke | 248/918 X |
| 5,108,057 | 4/1992 | Dandy, III et al. | 248/118 |
| 5,158,256 | 10/1992 | Gross | 248/118.3 |
| 5,161,760 | 11/1992 | Terbrack | 248/118 |

FOREIGN PATENT DOCUMENTS

| | | | |
|---|---|---|---|
| 4025143 | 2/1992 | Germany | 400/715 |

*Primary Examiner*—Karen J. Chotkowski

[57] ABSTRACT

A hand support positions the hand of a user over a computer keyboard for digital actuation of the keys comprising the keyboard. A hand rest is supported by gliders for parallel and perpendicular movement relative to the keyboard and is at an elevation for movement over the entire keyboard. A frame supports the gliders and defines cutouts for cable access to the keyboard and/or extension of a monitor from the keyboard and for supporting the arm of the user. A finger may then extend from the hand rest to the keys as the hand rest moves over the keyboard.

2 Claims, 2 Drawing Sheets

HAND GLIDING SUPPORT

BACKGROUND OF THE INVENTION

This invention relates to hand support devices and, more particularly, to hand support devices for moving the hand over a computer keyboard for actuation by a handicapped person.

There are many devices for supporting a hand and arm adjacent a computer keyboard. Such devices primarily act to reduce physical disabilities, such as carpal tunnel syndrome, from operation of the keyboard. One type of exemplary devices is a static support, such as shown in U.S. Pat. No. 4,913,390, that enables the wrist to be placed at a location selected anatomically for reduced stress.

Another type of exemplary support is shown in U.S. Pat. No. 5,050,826. An elevated support bar positions the wrist a selected distance above a keyboard. Sliding members are located on the support bar for positioning a hand parallel to the keyboard. The sliding members may also rotate to continuously support the arm, but not the hand, during actuation of the keyboard.

A disabled person, e.g., a stroke victim, cannot readily use the prior art devices since these devices require strength in the arm, wrist, and fingers to position the hand over the keyboard for finger actuation of the keys. Support is required for the hand while the fingers must still be able to access the keys on the keyboard. The prior art devices support the wrist or arm but do not serve to position the hand in an operative arrangement above the keyboard.

Accordingly, it is an object of the present invention to support the hand of a computer operator above a keyboard for digital access to the keyboard.

It is another object of the present invention to provide a hand support for movement in directions both parallel and perpendicular to the keyboard.

One other object of the present invention is to support both the hand and the arm while enabling the hand to be positioned directly above a keyboard.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a support assembly for positioning the arm and hand of a user over a keyboard. Support means supports the hand of the user. A first slider enables the support to be moved parallel to the keyboard. A second slider enables the support to be moved perpendicular to the keyboard. A frame supports the first and second sliders for movement of the support above the keyboard.

BRIEF DESCRIPTION OF THE DRAWINGS

The accompanying drawings, which are incorporated in and form a part of the specification, illustrate the embodiments of the present invention and, together with the description, serve to explain the pinciples of the invention. In the drawings.

DETAILED DESCRIPTION OF THE INVENTION

Figure 1:
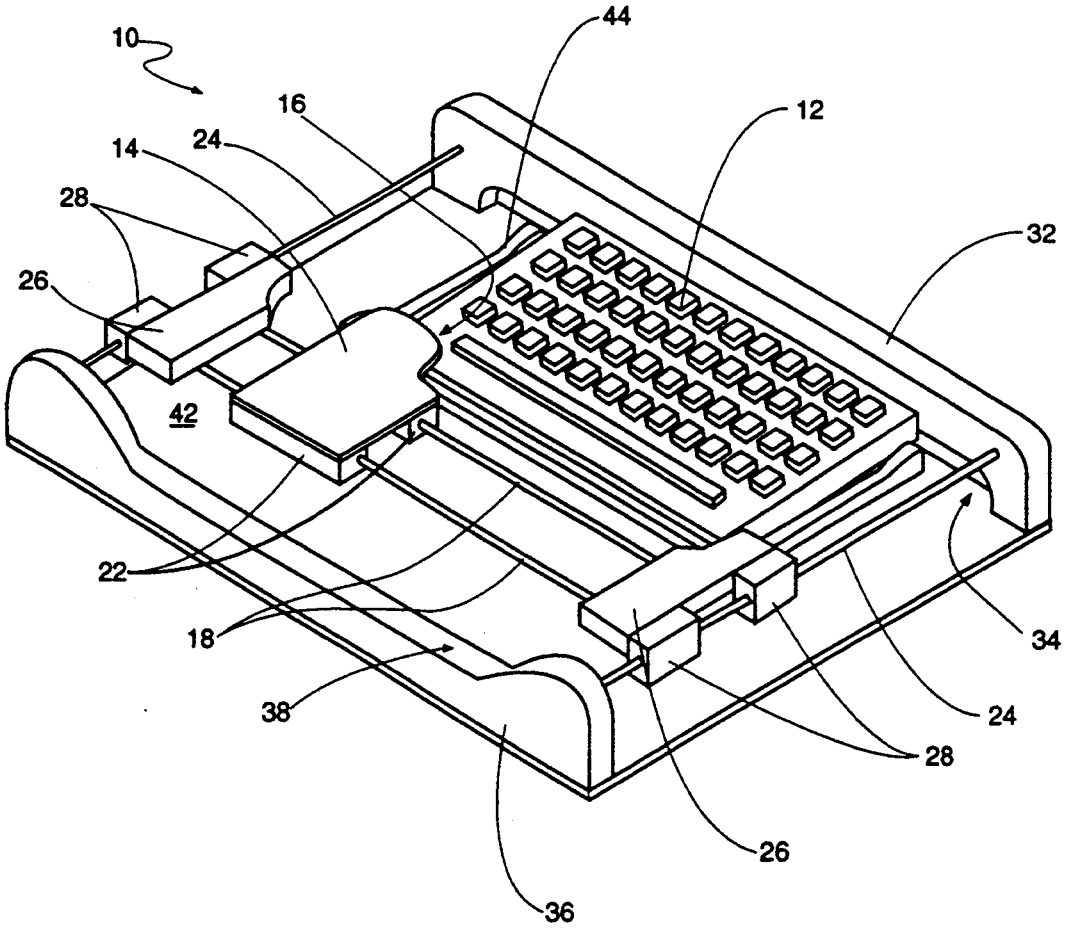
FIG. 1 is an isometric illustration of one embodiment of the present invention.
Figure 2:
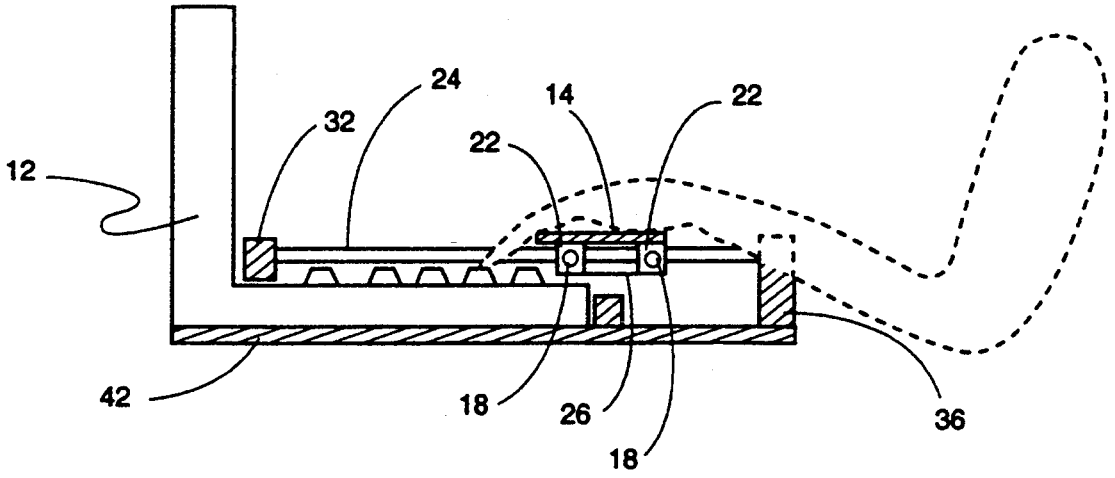
FIG. 2 is a pictorial illustration of the use of the device shown in FIG. 1.

FIG. 1 depicts an isometric illustration of hand gliding device 10 in operable proximity to computer keyboard 12. In FIG. 2, the arm and hand of a user are shown positioned on hand rest 14 with the arm resting along cutout 38. As hereinafter explained, one finger digit may be supported directly above keyboard 12 and extend downwardly through finger notch 16 to contact the keys. A digit can actuate keys on keyboard 12 while the hand is supported on hand rest 14.

It will be appreciated that the hand must be movable in both parallel and perpendicular directions over keyboard 12 to enable the operable digit to contact each key on keyboard 12. Accordingly, as shown in FIG. 1, hand rest 14 is supported on parallel support bars 18 by gliders 22 for movement of hand rest 14 parallel to keyboard 12. Gliders 22 are formed for easy movement along support bars 18. A simple and inexpensive glider 22 may be simply a block of low friction material, e.g., teflon, defining a hole therethrough to slide along bars 18. Other glider designs may be used, such as wheels or roller bearings.

Parallel support bars 18 are held by bar supports 26, which are supported in turn by perpendicular gliders 28 that are carried along perpendicular supports 24. Gliders 28 are typically formed in the same manner as gliders 22 and provide support and movement of hand rest 14 perpendicular to keyboard 12. Thus, hand rest 14 may be easily moved in both perpendicular and parallel directions relative to keyboard 12.

Perpendicular support bars 24 are supported by rear frame member 32 and front frame member 36 above keyboard 12 a distance effective for free movement of hand rest 14 while permitting an actuating digit to contact keyboard 12. Front frame member 36 preferably defines an arm support cutout 38 to engage the arm of the user while the hand is supported on hand rest 14. The arm slides over the surface of cutout 38 as the hand moves over keyboard 12.

Rear frame member 34 defines cutout 34, which has dimensions suitable to accept keyboard 12 and electrical connections to keyboard 12. Computer keyboard 12 may be a lap-top computer with an attached display (not shown), where the display is on the inside of frame member 32 or cutout 34 may be sized so that display may be on the outside of frame member 32.

Frame members 32 and 36 may be attached to bottom member 42 to form a rigid unit. Frame 44 may also be attached to bottom member 42 in order to locate computer 12 between frame members 32 and 36. Frame 44 is sized as needed to properly locate a variety of computers on bottom member 42.

Referring now to FIG. 2, there is depicted a pictorial illustration of the use of hand gliding device 10 shown in FIG. 1. Computer keyboard 12 is located on bottom member 42 within computer frame 44. As shown, keyboard 12 extends beneath rear frame member 32. Hand rest 14 is supported above parallel support bars 18 and perpendicular support bars 18 on parallel gliders 22.

The hand and arm of a user are shown supported above keyboard 12. The hand of the user rests on hand rest 14. One finger digit is enabled to extend from the hand beneath hand rest 14 and over keyboard 12 in order to contact the keys on keyboard 12. Hand rest 14 slides along perpendicular support 24 and parallel support bars 18 whereby the user's hand can traverse the entire keyboard 12. The arm of the user is slidingly supported along cutout surface 38 to further enable a handicapped user to move over a keyboard.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for supporting and positioning a hand of a user over a computer keyboard, comprising:

support means operably configured for supporting said hand while enabling a selected digit on said hand to extend beneath said support means for contacting said keyboard;

first glider means for moving said support means parallel to said keyboard;

second glider means for moving said support means perpendicular to said keyboard; and a frame for supporting said first and second glider means for movement of said support means above said keyboard, where said frame includes a first member parallel to said keyboard and defining a surface lower than said support means for support said arm during movement of said hand over said keyboard.

2. Apparatus according to claim 1, further including means for locating and holding said keyboard within said frame.

* * * * *